United States Patent [19]

Breeding

[11] Patent Number: 4,807,884

[45] Date of Patent: Feb. 28, 1989

[54] CARD SHUFFLING DEVICE

[75] Inventor: John G. Breeding, St. Louis Park, Minn.

[73] Assignee: Shuffle Master, Inc., St. Louis Park, Minn.

[21] Appl. No.: 138,440

[22] Filed: Dec. 28, 1987

[51] Int. Cl.[4] ..... A63F 1/12

[52] U.S. Cl. ..... 273/149 R

[58] Field of Search ..... 273/149 R

[56] References Cited

U.S. PATENT DOCUMENTS

| | | | |
|---|---|---|---|
| 2,701,720 | 2/1955 | Ogden | 273/149 R |
| 2,705,638 | 4/1955 | Newcomb | 273/149 R |
| 2,711,319 | 6/1955 | Morgan et al. | 273/149 R |
| 2,714,510 | 8/1955 | Oppenlander et al. | 273/149 R |
| 2,727,747 | 12/1955 | Semisch, Jr. | 273/149 R |
| 2,731,271 | 1/1956 | Brown | 273/149 R |
| 2,747,877 | 5/1956 | Howard | 273/149 R |
| 2,755,090 | 7/1956 | Aldrich | 273/149 R |
| 2,757,005 | 7/1956 | Nothaft | 273/149 R |
| 2,760,779 | 8/1956 | Ogden et al. | 273/149 R |
| 2,778,643 | 1/1957 | Williams | 273/149 R |
| 2,778,644 | 1/1954 | Stephenson | 273/149 R |
| 2,782,040 | 2/1957 | Matter | 273/149 R |
| 2,790,641 | 4/1957 | Adams | 273/149 R |
| 2,793,863 | 5/1957 | Liebelt | 273/149 R |
| 2,815,214 | 12/1957 | Hall | 273/149 R |
| 2,821,399 | 1/1958 | Heinoo | 273/149 R |
| 3,107,096 | 10/1963 | Osborn | 273/149 R |
| 3,131,935 | 5/1964 | Gronneberg | 273/149 R |
| 3,305,237 | 2/1967 | Granius | 273/149 R |
| 3,588,116 | 6/1971 | Miura | 273/149 R |
| 3,589,730 | 6/1971 | Slay | 273/149 R |
| 3,627,331 | 12/1971 | Erickson | 273/149 R |
| 3,666,270 | 5/1972 | Mazur | 273/149 R |
| 3,929,339 | 12/1975 | Mattioli | 273/149 R |
| 3,944,230 | 3/1976 | Fineman | 273/149 R |
| 4,033,590 | 7/1977 | Pic | 273/149 R |
| 4,310,160 | 1/1982 | Willette et al. | 273/149 R |
| 4,421,312 | 12/1983 | Delgado et al. | 273/149 R X |
| 4,497,488 | 2/1985 | Plevyak et al. | 273/149 R |
| 4,512,580 | 4/1985 | Matviak | 273/149 R X |
| 4,513,969 | 4/1985 | Samsel, Jr. | 273/149 R |
| 4,515,367 | 5/1985 | Howard | 273/149 R |
| 4,586,712 | 5/1986 | Lorber et al. | 273/149 R |

*Primary Examiner*—Anton O. Oechsle

*Attorney, Agent, or Firm*—Merchant, Gould, Smith, Edell, Welter & Schmidt

[57] ABSTRACT

Discloses an apparatus automatically shuffling a deck of cards. The device includes a deck stacking zone, a carriage section for separating the deck into two portions, a sloped mechanism for disposition between adjacent corners of the deck and apparatus for snapping the cards over the sloped mechanism, thereby interleafing the cards. Push members are provided to slide the interleafed deck portions into a single stack. Mechanism is also present for transporting the shuffled deck into a dealing shoe.

16 Claims, 11 Drawing Sheets

CARD SHUFFLING DEVICE

FIELD OF THE INVENTION

The present invention relates to gaming devices and more particularly to an automatic card shuffling device.

BACKGROUND OF THE INVENTION

Card games have been popular for many years. Card games are games of chance in which a deck of cards is mixed to provide a random sequence of cards within the deck. For example, one highly popular game is that of Blackjack. Numerous business establishments operate Blackjack tables. The operation normally includes an employee that shuffles and distributes the cards to the players. The players then proceed one by one to play their various cards. A perennial problem for Blackjack establishments is the so-called "card counters". Some persons have an excellent memory whereby they can recall what cards have been played even though numerous players are involved and many cards have been distributed and played. Initially, a Blackjack game is one of chance. However, as the game progresses a Blackjack counter can within his own mind change the game from one of chance to one of memory, in other words, know what cards have been played. The card counter can mentally determine the change in odds as far as winning. Thus, a Blackjack counter can make small bets initially. As he recognizes the cards played and in turn the cards remaining, he can place large bets as the odds for him change, thus taking advantage of the gambling establishment.

It has long been desired to develop a mechanized card shuffler such that the deck may be often shuffled and yet leave the dealer adequate time to operate the game. Previous card shuffling devices have had numerous disadvantages, many of which dictate that the card shuffling devices cannot be used in a gambling establishment. For example, in some instances the card shuffling device may slightly damage the cards, thus resulting in marking of the cards. Professional card players quickly recognize a damage mark on a card and thus know the value of that card. In other instances, the prior card shuffling device has required the complete attention of the card dealer and thus does not permit the dealer to continue the game as the shuffling takes place. In still other instances, the card shuffling device is a large cumbersome device in which the cards are not always in view which is contrary to the essential rules in a professional gambling house.

The present invention overcomes the disadvantages found in such prior art card shuffling devices.

SUMMARY OF THE INVENTION

The present invention provides a card shuffling device that may be automatically operated to repeatedly shuffle a deck and then deposit the shuffled deck into a dealing shoe. The card shuffling device includes a zone into which the deck of cards may be initally deposited. The device further includes a carriage section which provides mechanism for separating the deck into two portions, e.g. an upper and a lower portion, to permit movement of a carriage beneath a portion of the deck, then transport that upper deck portion to a position adjacent the lower deck portion. The carriage section includes mechanism e.g. a Geneva Mechanism for rotating the upper deck portion to a position in angular relationship to the lower deck portion with adjacent corners in close proximity. The card shuffling device has a frustaconical member which moves upwardly thereby raising such adjacent corners of the stacked card portions. Fingers, e.g. rollers are provided to press the card deck portions downwardly thus causing them to snap over the frustaconical portion creating an interleafing of the cards. The Geneva Mechanism then provides for pivotal movement of the carriage back to a position in which the card deck portions are aligned. The carriage pushes the two card deck portions together again creating a single deck stack. The card shuffling device is adapted to repeatedly move through such sequence of function, thus repeatedly shuffling the cards creating true, random distribution of the cards in the stack.

IN THE DRAWINGS

DETAILED DESCRIPTION OF THE INVENTION

Figure 1:
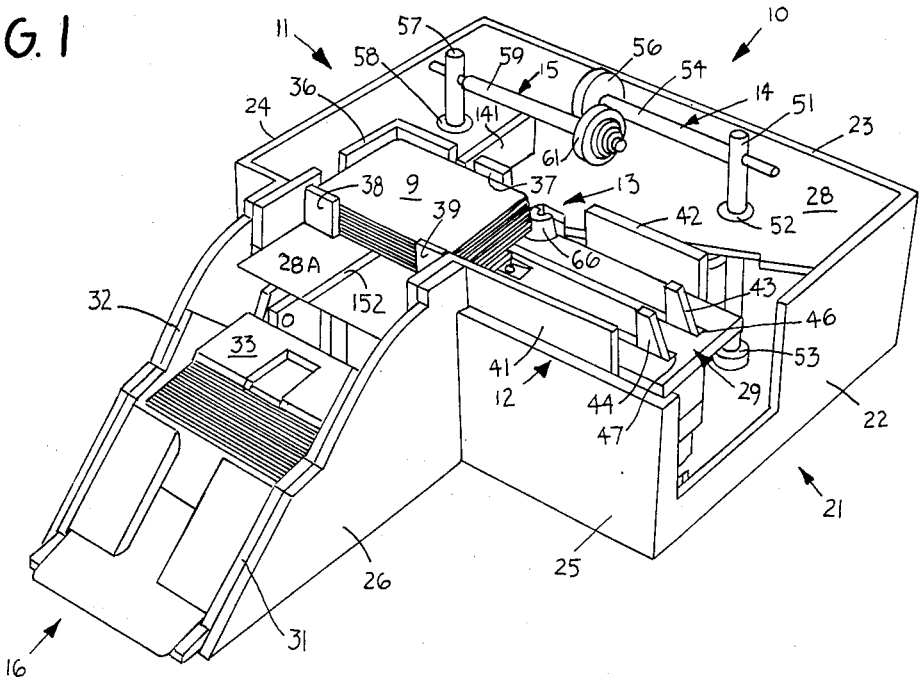
FIG. 1 is a perspective view of the card shuffling device of the present invention.

The card shuffling device 10 (FIGS. 1–6) of the present invention includes a card stacking section 11, a carriage section 12, a sloped mandrel or frustoconical support section 13, a pair of fingers, e.g. rollers 14 and 15 and a shoe 16. The entire card shuffling device is supported within a frame 21 including walls 22, 23, 24, 25 and 26, a floor 27, a primary platform 28 and a secondary or carriage platform 29., The shoe portion 16 includes a pair of sidewalls 31, 32, an upper platform 33 and a floor 34. The various moving components are driven by suitable motors and gears.

The card stacking zone 11 is defined by a portion 28*a* of the frame platform 28 and the upstanding wall portions 36, 37 and the reciprocating wall portions 38, 39. Mechanism, such as a solenoid (not shown), is provided beneath platform 28 for withdrawing walls 38 and 39 when a shuffled deck is to be moved into shoe 16.

Figure 2:
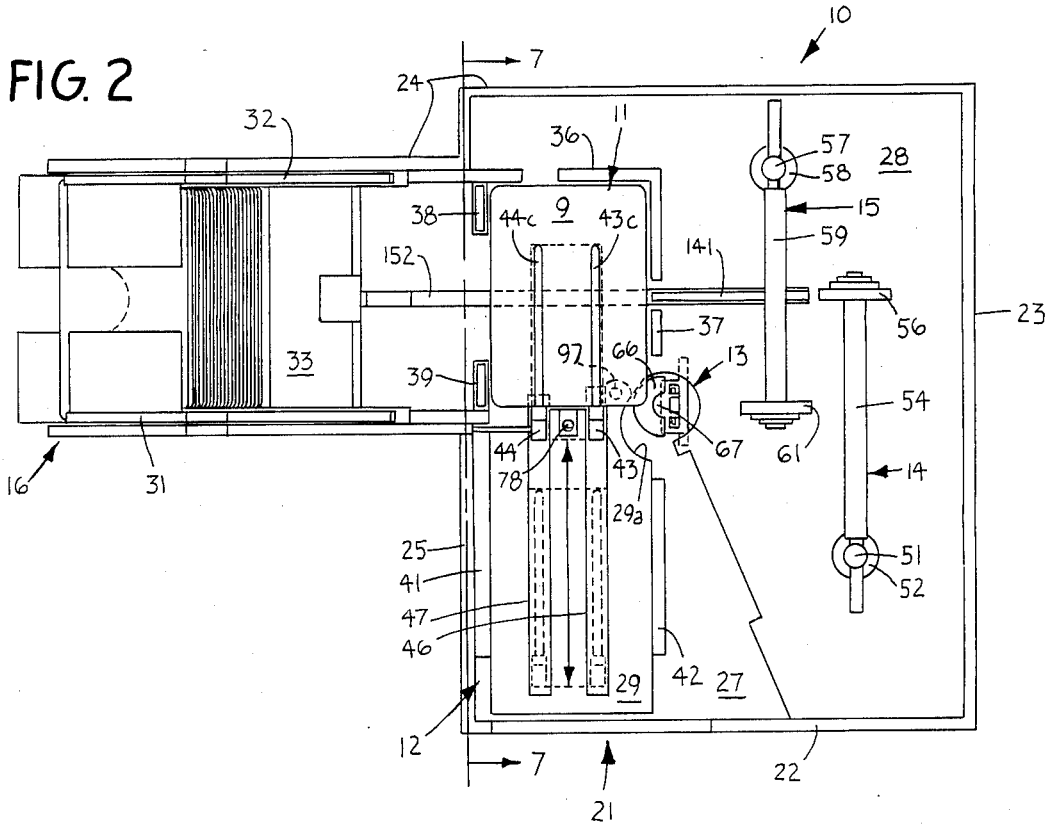
FIG. 2 is a top plan view of the present invention showing the cards disposed in the stacking zone.
Figure 3:
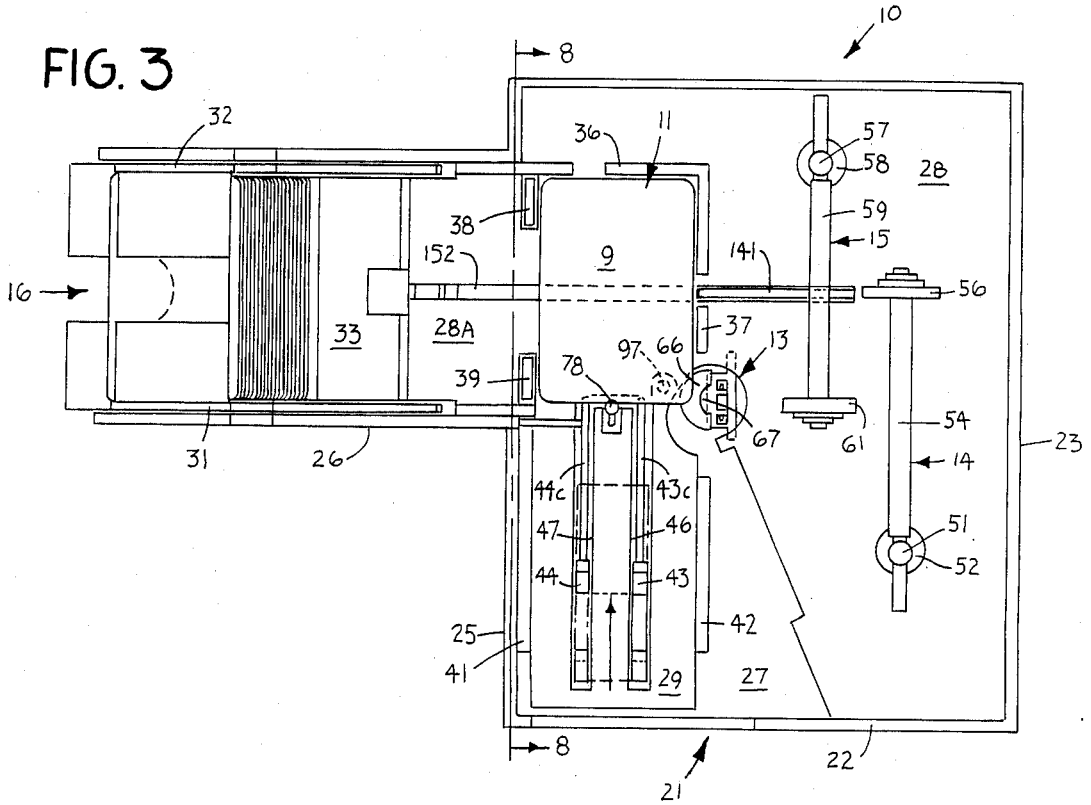
FIG. 3 is a top plan view in which the mechanism for separating the stack into two portions is in operation.
Figure 4:
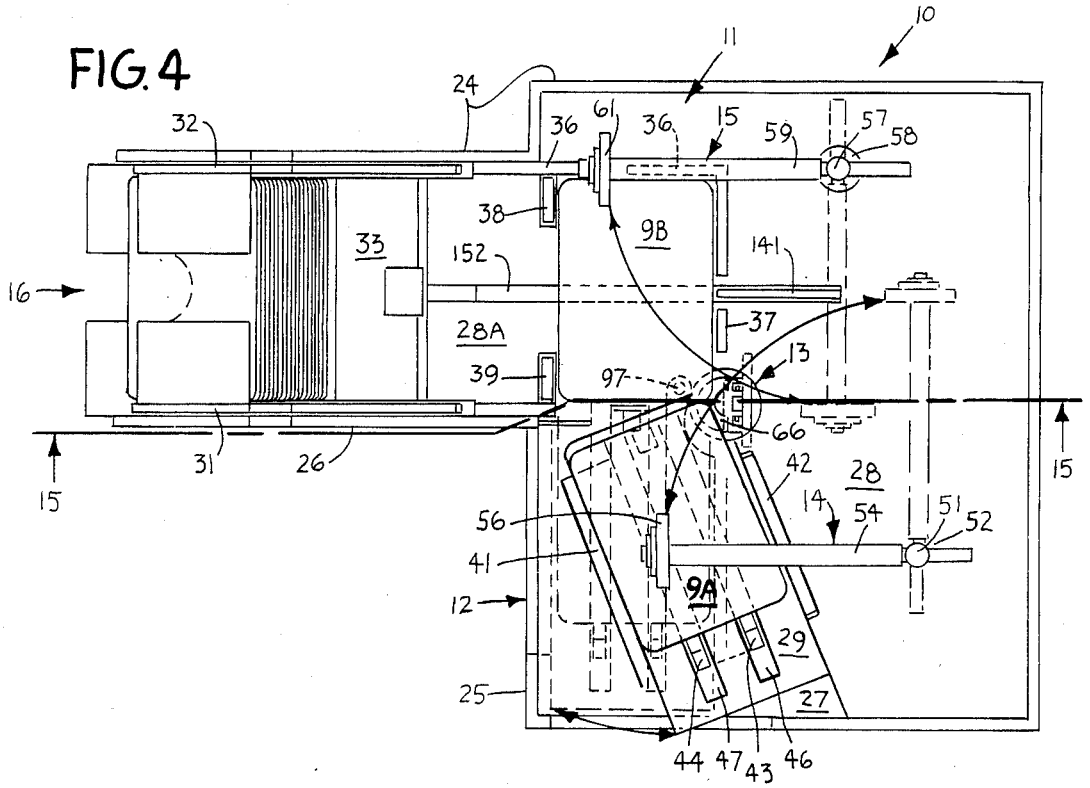
FIG. 4 is a top plan view in which the carriage section is rotated to provide an angular relationship between the card deck portions.

The carriage section 12 includes a carriage platform 29, a pair of sidewalls 41, 42, and the travelling push members 43, 44. The pus members 43, 44 are supported from beneath as hereinafter described. The push members 43, 44 may travel along a corresponding pair of slots 46, 47 defined in carriage platform 29. The carriage platform 29 is substantially rectangular in shape as illustrated in FIG. 2, however, it has an arcuate portion 29*a* for purposes of permitting movement of mandrel 13 past platform 29 during operation.

Finger 14 includes a vertical shaft 51 which is supported in a pair of bearings 52, 53. Finger 14 has a horizontal shaft 54, one end of which is supported in vertical shaft 51, the other end of which carries a roller 56. The finger 15 is similarly constructed including a vertical shaft 57 suitably supported in bearings such as bearing 58. The finger 15 has a horizontal shaft 59 which is supported at one end by the vertical shaft 57 and has rotatably mounted on the opposite end a roller 61. The rollers 56 and 61 may be suitably secured on their respective shafts 54 and 59 by any conventional mechanism such as split rings. The roller 15 is disposed sufficiently forward of roller 14 and leads roller 14 sufficiently to provide clearance between the rollers as they move from the position of FIG. 2 to the position of FIG. 4. The rollers 56 and 61 are sufficiently elevated to clear the deck portion when lying flat on the platforms 28 and 29 and yet low enough to provide downward and forward force on the deck portions when corners of the deck portion are flexed upwardly by the mandrel.

The mandrel section 13 may include sloped support member 66 which is suitably mounted on a vertically reciprocating rod such as 67. The member 66 may be a frustaconical member or a portion of a frustaconical structure. As illustrated in FIG. 2, the sloped support member 66 is disposed with a portion lying beneath the stack of cards for purposes hereinafter described.

Figure 15:
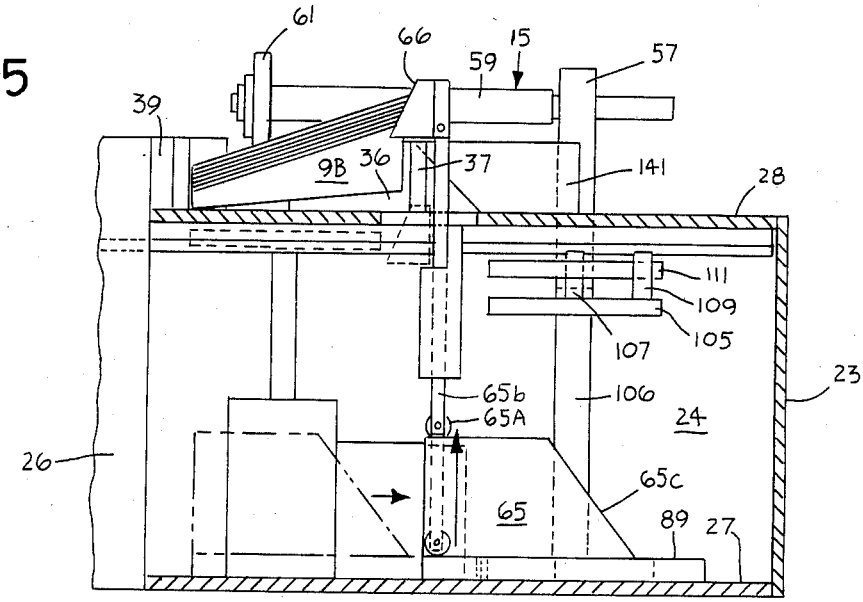
FIG. 15 is a view with certain parts removed illustrating movement of the roller into a position where it presses downwardly on the deck portion and illustrating the mechanism for moving the frustaconical portion into its uppermost position of operation.

The sloped card support member 66 may be reciprocably driven by any desired mechanism e.g. a solenoid. Another suitable mechanism is shown in FIG. 15 as a reciprocating sloped slide 65 which acts on a roller 65*a* and post 65*b*. As the slide 65 moves rightwardly from the position shown in phantom, the roller moves up the sloped portion 65*c* thereby elevating member 66 to the position shown in FIG. 15.

Referring now to FIGS. 7–10, and 13, one can observe the structure of the carriage section 12 including a lower support platform 71 which may be suitably secured and supported with respect to the platform 29. For example, support 71 may be secured in place by a plurality of straps or bars such as 70*a* and 70*b* which are secured at the upper end thereof to platform 29 and at the lower ends thereof to support 71, for example, using screws not shown.

Figure 7:
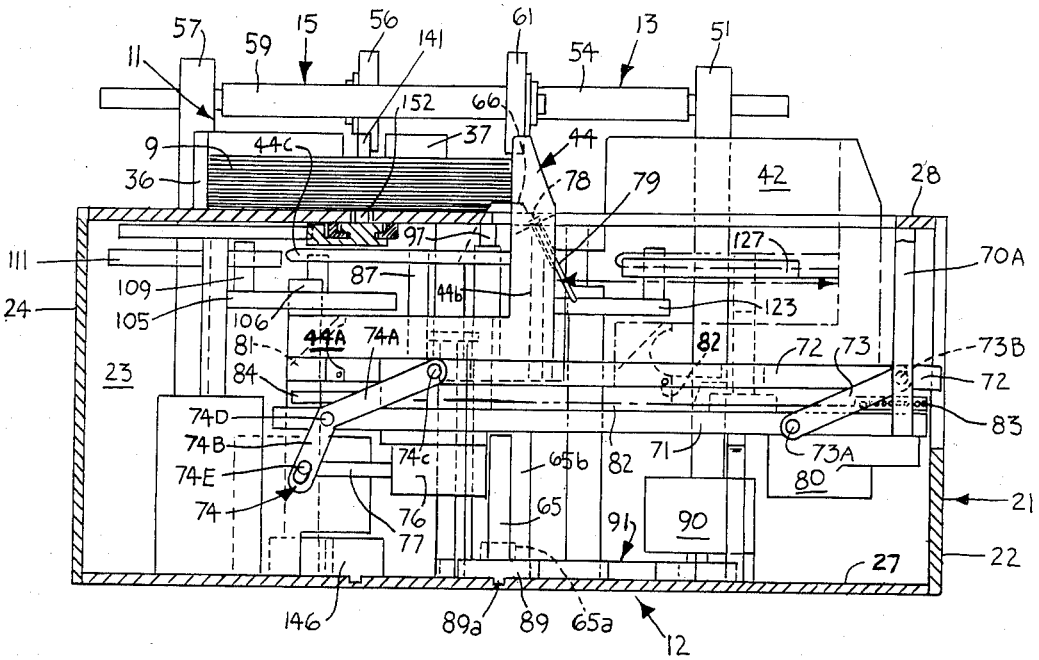
FIG. 7 is a sectional view taken generally along the line 7—7 in FIG. 2 with certain parts removed for purposes of more clearly showing the parts illustrated.

The carriage section 12 includes an upper support platform 72 which is mounted on platform 71 by a plurality of straps such as 73, 74. Strap 73 is pivotally secured at its lower end to member 71 by a suitable pin 73*a*, and at its upper end to member 72 by pin 73*b*. The strap 74 is L-shaped having an upper portion 74*a* and a lower portion 74*b*. The strap 74 is pivotally secured to member 72 such as by pin 74*c* and to the lower platform 71 by pin 74*d*. A solenoid 76 is mounted to the lower side of platform 71. The solenoid arm 77 extends leftwardly as illustrated in FIG. 7 and is pivotally secured to strap 74 by pin 74*e*. The solenoid 76 serves to raise and lower the member 72 with respect to member 71 by reciprocation of the arm 77.

The carriage section 12, FIGS. 7–10, carries the push members 43, 44 along the upper surface of platform 72. A suitable slide may be defined in the upper surface of platform 72. The push member 44 includes a lower portion 44*a* and a vertical portion 44*b*. A rod 44*c* extends leftwardly from the vertical portion 44*b*. The push member 43 may be constructed substantially identical to push member 44. Suitable cross supports may be provided between push members 43 and 44 to lock such members for movement in common.

Figure 8:
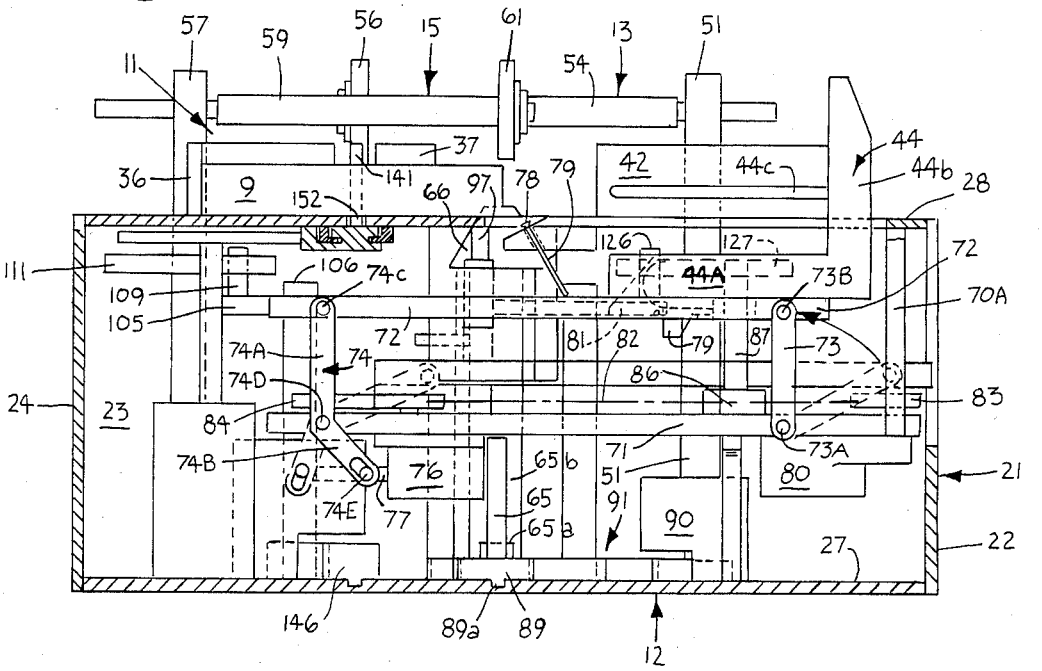
FIG. 8 is a sectional view taken generally along the lines 8—8 in FIG. 3 with certain parts removed for purposes of more clearly showing the parts illustrated.
Figure 9:
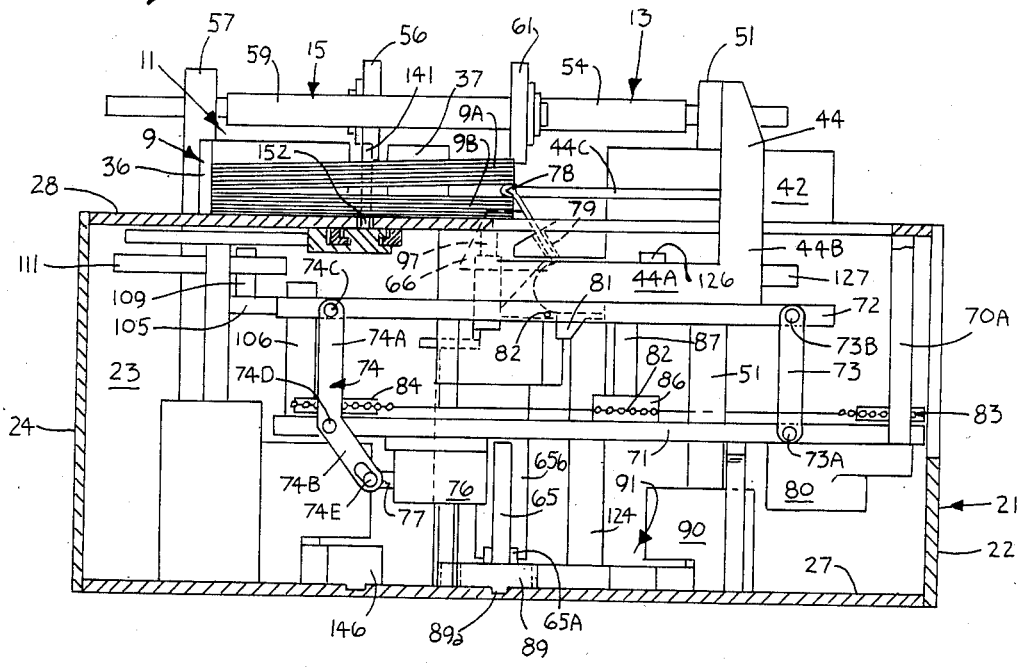
FIG. 9 is a sectional view similar to FIG. 8 except showing the carriage separating the deck into two portions with the carriage moving beneath the upper deck portion.
Figure 10:
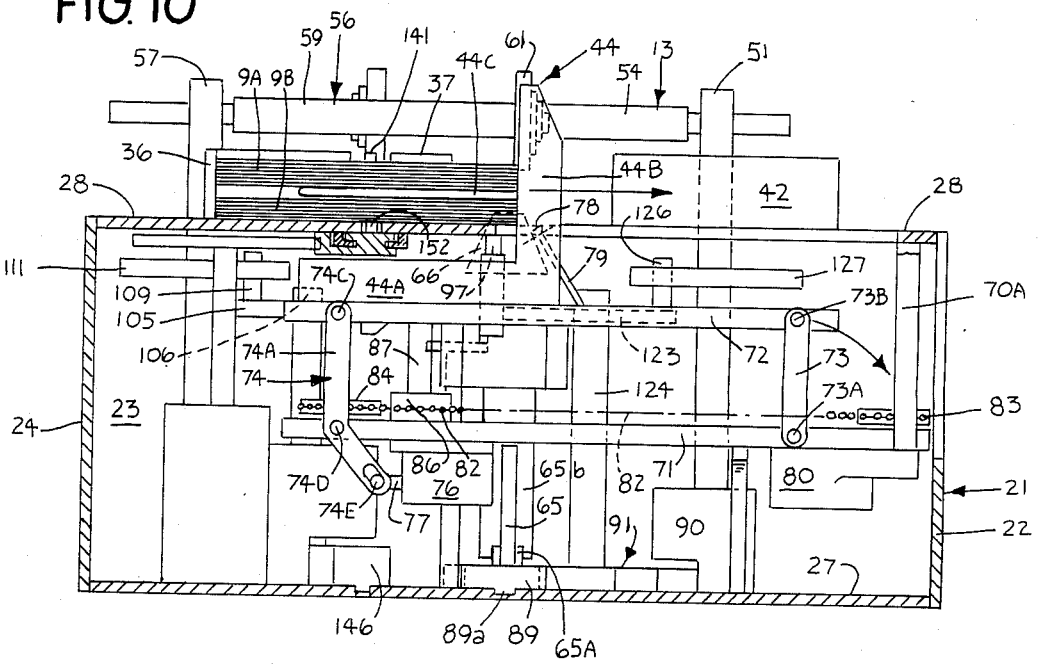
FIG. 10 is a view similar to FIG. 9, however, showing the carriage moved into full position beneath the upper deck portion.

When the carriage platform 72 is in the upper position as illustrated in FIG. 8–10, the leftwardly extending rods 43*c* and 44*c* are disposed on a plane which bisects the stack of cards. The push members 43 and 44 may be translated along platform 72 and the slots 46, 47 by any suitable mechanism such as reversible motor 80 mounted on platform 71. The motor 80 drives a chain 82 suitably supported on sprockets 83 and 84. A sprocket 86 is supported on a shaft 87 extending downwardly from the push members 43 and 44. The motor 80 drives the chain 82 which in turn causes the push members 43 and 44 to move rightwardly or leftwardly depending on the direction motor 80 is operating.

Figure 11:
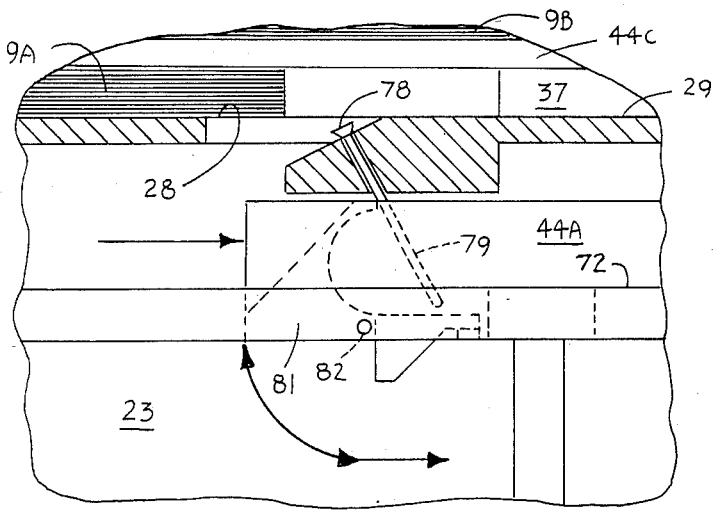
FIG. 11 is an enlarged fragmentary section of the card shuffling device illustrating the separator mechanism.
Figure 12:
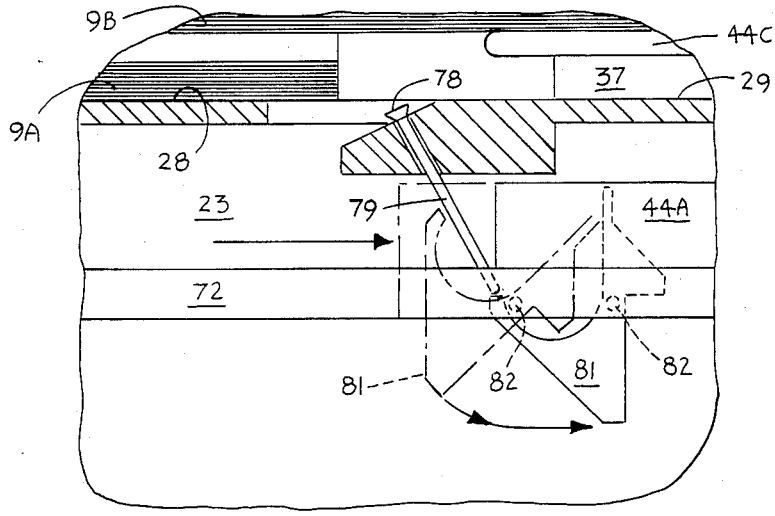
FIG. 12 is a view similar to FIG. 11, however, in a different position of operation.

The carriage section 12 further includes a reciprocating pin 78 which may be mounted in a guide 79. The incline plane member 81 is mounted midway between push members 43 and 44. Member 81 is pivotally supported on shaft 82, which extends between push members 43 and 44. The incline plane member 81 may be moved along carriage member 72 such that it slides beneath pin 78 moving the pin upwardly until the pin separates the card deck into two portions as illustrated in FIG. 9 at which point the push members 43, 44 move leftwardly to slide the rods 43*c* and 44*c* into the space between the upper portion 9*a* of the deck and the lower portion 9*b* of the deck. FIG. 10 illustrates such rods 43*c* and 44*c* fully disposed between the card deck portions. In the position of FIG. 10, the upper deck portion 9*a* is supported on the rods 43*c* and 44*c*. Member 81 has sufficient weight to the right of pin 78 as seen in FIG. 11 to assure that member 81 is normally in the position shown in FIG. 11. Once the pin 78 is to the rear of member 81, pin 78 falls to the position shown in FIG. 11 When the carriage again moves to the right, member 81 is forced to pivot out of the way as illustrated in FIG. 12 to pass by pin 78. Once past pin 78, member 81 again pivots into position.

The carriage section 12 is entirely supported on a shaft 97. The upper end of shaft 97 may be rotatably secured to the platform 28 and the lower end to floor 27. The carriage may be pivoted from the position illustrated in FIG. 3 to the angled position illustrated in FIG. 4 by movement of Geneva Mechanism hereinafter described. This may be driven by a rack and slide system as hereinafter described.

Figure 14A:
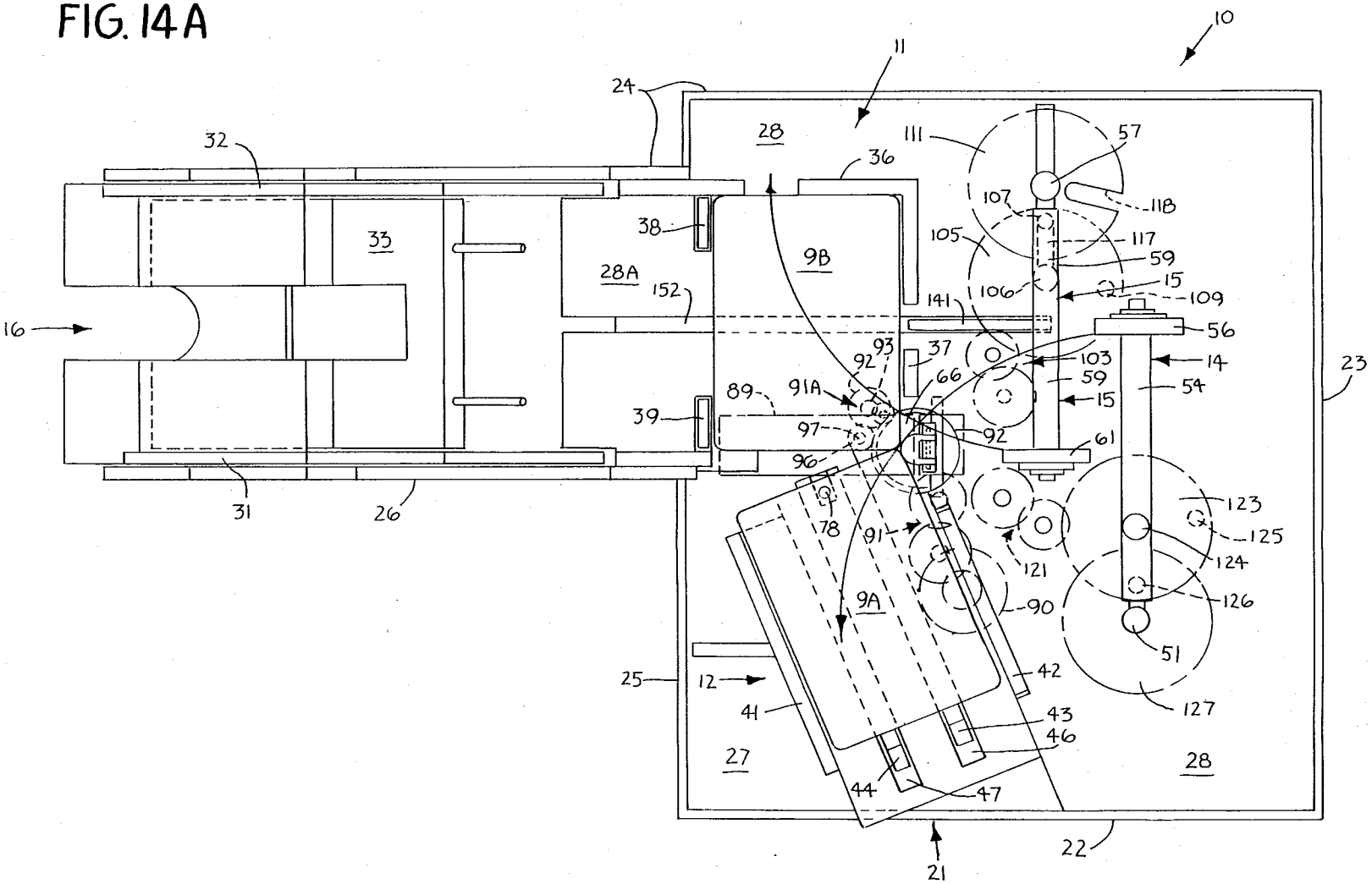
FIG. 14A is a top plan view similar to FIG. 4, however, showing the drive mechanism for the various components.
Figure 14B:
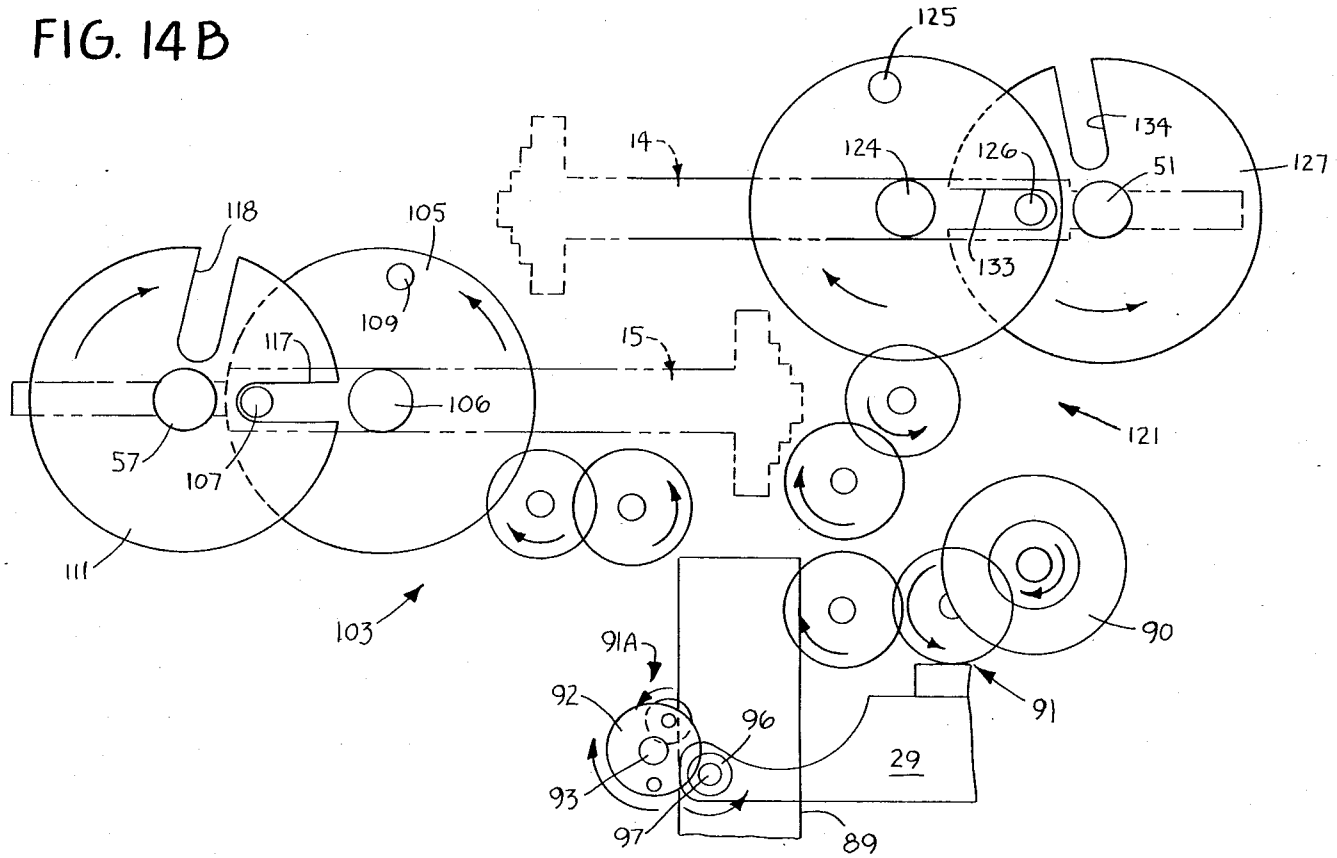
FIG. 14B is a schematic view illustrating the Geneva Mechanism and movement of the Geneva Mechanism of the present invention.

The drive mechanism for the present invention is illustrated in FIG. 14. The drive mechanism includes a rack 89 which is suitably supported on the floor of the frame 21. The rack 89 is conventionally mounted in a slide frame 89*a*. The rack 89 is driven by a DC motor 90 which drives a gear train 91 which interacts with and drives one of the toothed sides of the rack 89. The gear motor 90 is reversible to move the rack 89 first in one direction and later in a second direction. The rack 89 in turn drives the gear train 91A and shaft 93 with the driving member 92 of a Geneva Mechanism. The gear 92 carries an upstanding pin for engagement with the driven member 96 of a Geneva Mechanism. The driven member 96 is suitably supported on a shaft 97 for rotational movement. The pin 94 engages in the slot 100, thereby rotating the member 96 and shaft 97 as the member 92 rotates. This moves the secondary platform 29 from the aligned position to the angularly displaced position as previously described.

The finger 15 is moved by a Geneva Mechanism including a driver 105 which is supported on a shaft 106. A gear train 103 is disposed between the rack 89 and the driver 105. The rack 89, through the gear train 103 powers the driver 105. The driver 105 in turn powers the driven member 111 which is mounted on a shaft 59. The member 111 includes elongated slots 117 and 118 for reception of pins 107 and 109 on driver 105. When the rack is moved rightwardly as viewed in FIG. 14, then finger 15 is moved in a clockwise direction to the position indicated in FIG. 4. When the rack is moved leftwardly, the finger 15 is moved in a counterclockwise direction.

The finger 14 is operated by a Geneva Mechanism including a driver 123 which is supported on a shaft 124. A gear train 121 is disposed between the rack 89 and the driver 123. The driver 123 carries upstanding pins 125 and 126 for engagement with the driven member 127. The member 127 is supported on a shaft 51 and includes the elongated slots 133 and 134 for reception of pins 125 and 126. The rack 89 moves finger 14 in a counterclockwise direction when the rack 89 moves rightwardly. The finger 14 moves to the position shown in FIG. 4. When rack 89 moves in the opposite direction, the finger 14 is oppositely moved.

Figure 17:
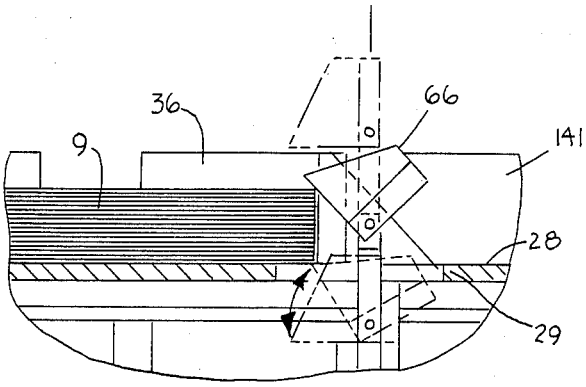
FIG. 17 is an enlarged fragmentary section illustrating movement of the frustaconical portion into a position where it presses downwardly on the interleafed cards and illustrating the movement of the frustaconical portion about its hinge axis to a reset position.
Figure 18:
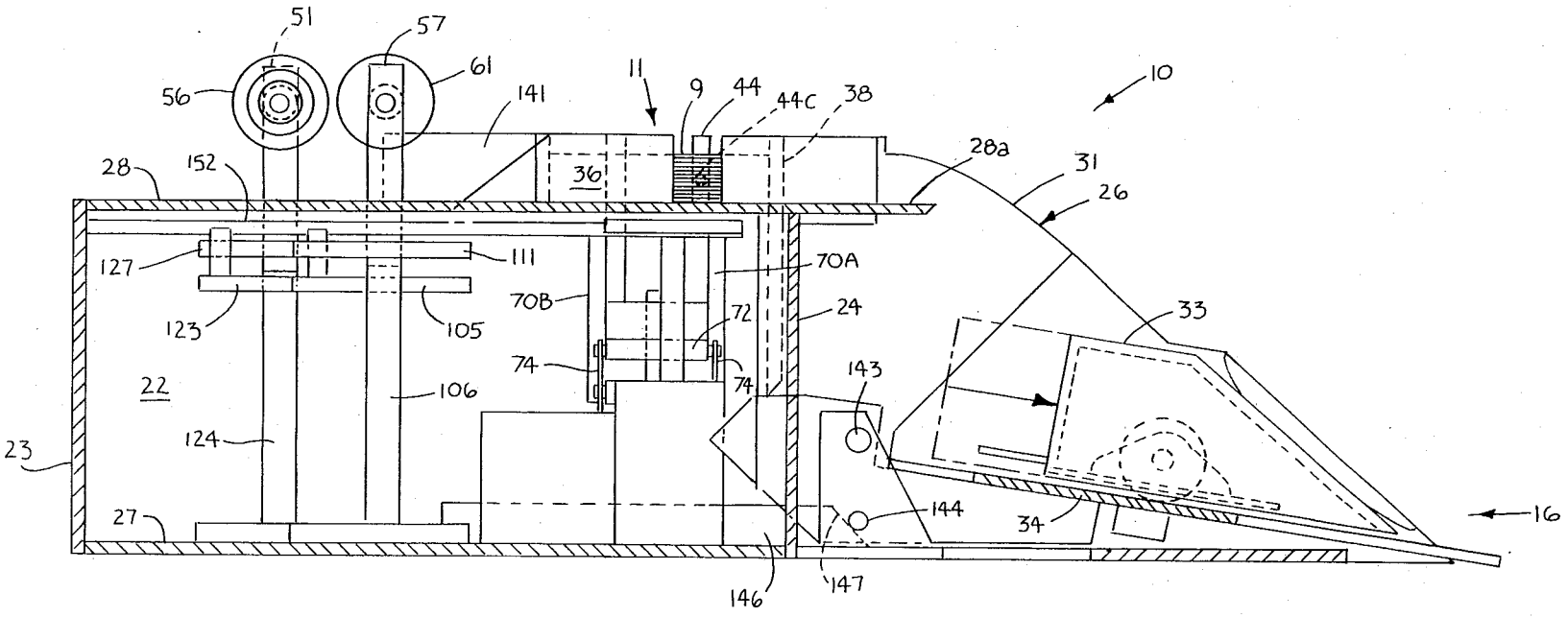
FIG. 18 illustrates the mechanism for movement of the dealing shoe into a position for receipt of the shuffled deck.

The shoe 16 as illustrated in FIGS. 1, 17 and 18, for example, has a pair of side walls 141 and 142 with interconnecting platforms such as 33. The shoe 16 is pivotally supported to the frame 21 such as by pin 143. The shoe 16 has a drive pin 144 which acts together with a drive push rod 146 to raise and lower the shoe. The push member 146 has a sloped forward surface 147 which moves beneath the pin 144. As the pin 144 slides upwardly along the slope 147, the shoe is raised to the position illustrated in FIG. 18. Push rod 146 is driven rightwardly and leftwardly by motor 146A and suitable rack and gear mechanism. The walls 38 and 39 may be withdrawn by any suitable mechanism such as a solenoid located beneath platform 28. In this position, the deck push member 141 moves rightwardly as viewed in FIG. 18 to move the deck into the shoe. The member 141 is driven rightwardly and leftwardly by a motor 141A and suitable rack and gear mechanism.

The member 141 slides along a slot 152 in the platform 28. The push member 146 and the push member 151 are then retracted permitting the shoe 16 to move downwardly into the position illustrated in FIG. 1.

Microcircuits may be provided for timing the various movements of parts. Controls with settings for the number of shuffles, sensing of empty shoe, then delivery of the shuffled deck may be provided.

OPERATION OF THE PRESENT INVENTION

Although the operation of the present invention is apparent from its overall construction, it will be further described hereinafter for a more complete understanding. Referring to FIG. 1, a deck of cards 9 is disposed in the card stack section 11 within the walls 36, 37, 38, 39. The push members 43, 44 of the carriage section 12, while in the lowermost position, move leftwardly to engage the card deck 9 as illustrated in FIG. 2, thereby assuring that the cards in the deck 9 are uniformly stacked. The push members 43,44 then move rightwardly to the position illustrated in FIG. 7.

The solenoid 76 is activated and raises the carriage member 72 to the position illustrated in FIG. 8. This elevates push members 43, 44 and the rods 43*c*, 44*c*. As the carriage push member 43, 44 moves leftwardly, the incline plane member 81 is moved leftwardly as viewed in FIG. 7 to engage the pin 78 causing it to move upwardly to the position illustrated in FIG. 9 where it separates the deck into two portions 9*a*, 9*b*. The carriage push members 43, 44 then continues the move leftwardly as illustrated in FIGS. 9 and 10, until the upper deck portion 9*a* is supported on the rods 43*c* and 44*c* as illustrated in FIG. 10. The pin 78 retracts. The members 43,44 then move rightwardly. As incline plane member 81 moves lefwardly past pin 78 and then moves FIGS. 11, 12 rightwardly member 81 pivots out of the way to move past pin 78.

Figure 13:
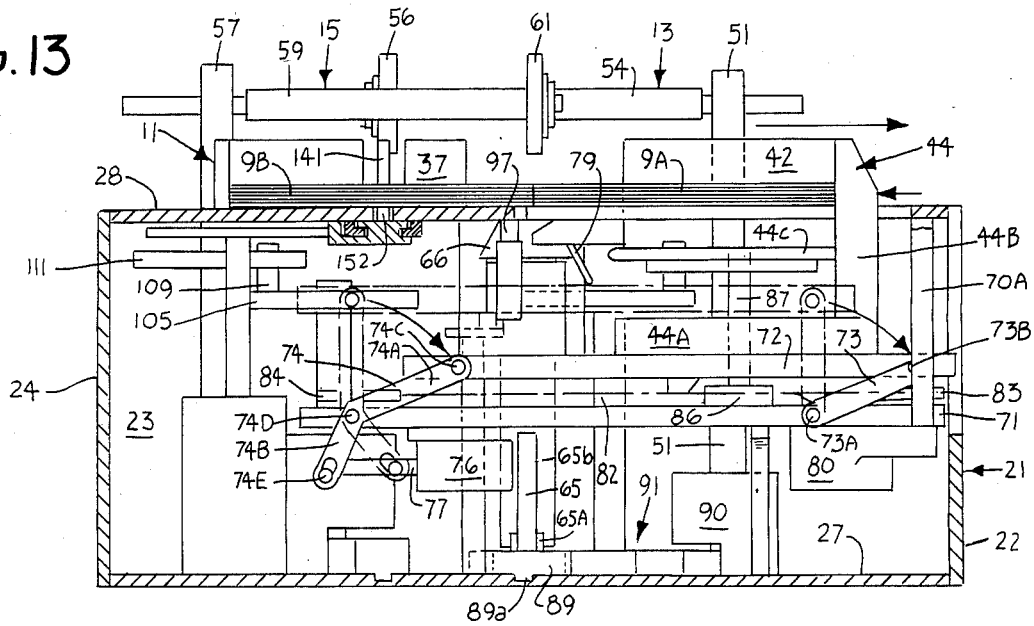
FIG. 13 is a sectional view similar to FIG. 8, however, in a different position of operation.

The solenoid 76 lowers the carriage member 72 to the position illustrated in FIG. 13. This deposits the card deck portion 9*a* on the platform 29 of the carriage section 12.

Figure 5:
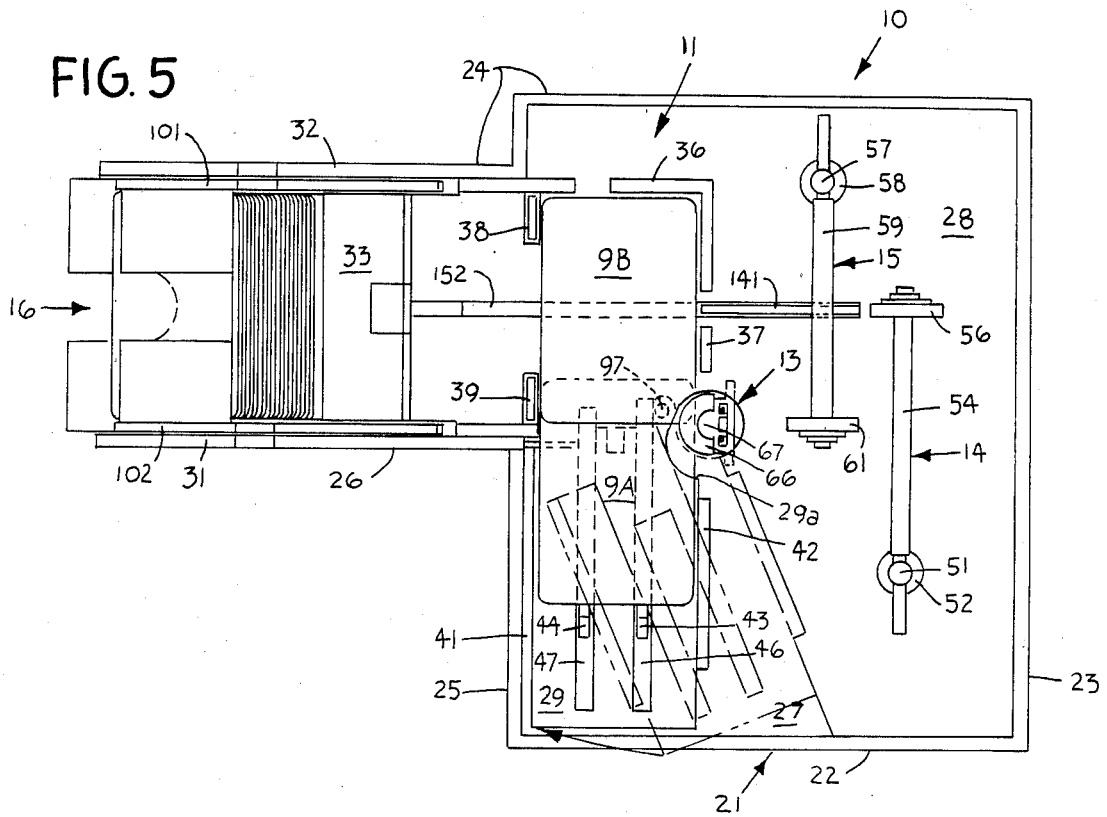
FIG. 5 is a top plan view in which the carriage has been returned to the aligned position and the cards are being moved into a single stacked condition.
Figure 6:
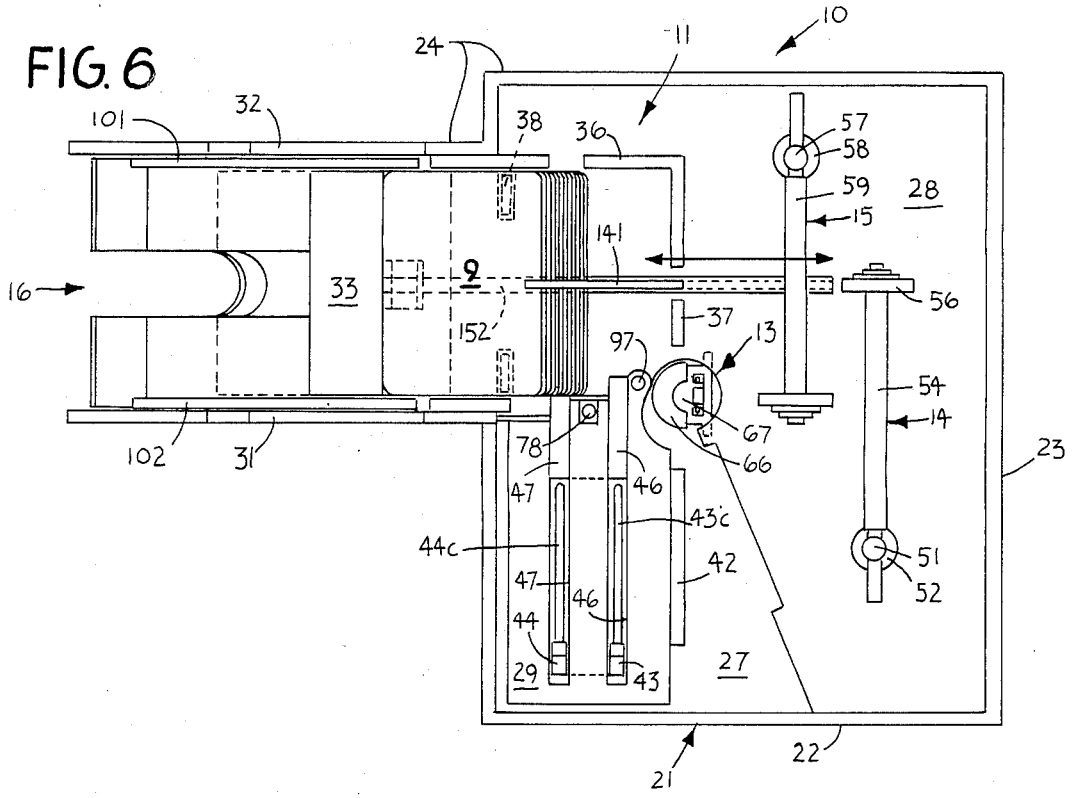
FIG. 6 is a top plan view illustrating movement of the stacked cards into the dealing shoe.
Figure 16:
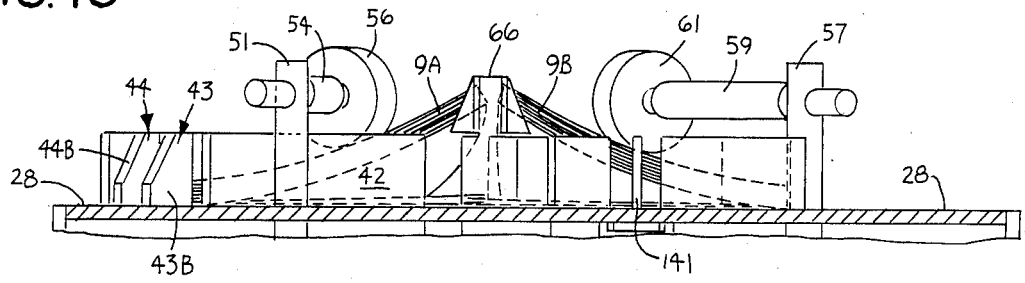
FIG. 16 is a partial view illustrating the action of the rollers in producing the interleafing of the cards.

The carriage section 12 is then pivoted by the Geneva Mechanism to the position illustrated in FIG. 5 such that the card deck portions are angularly oriented with respect to each other. Mechanism 65 is then activated to raise the mandrel member 13 to engage the lower side of each of the deck portions as illustrated in FIG. 16. The rollers 14 and 15 then rotate toward the mandrel member 13, snapping the cards over such mandrel member 13 into an interleafed position. The carriage section 12 next is pivoted back to its original aligned position with the adjacent portions of the two deck portions interleafed. The members 43 and 44 then move leftwardly to again form the stacked deck as illustrated in FIG. 7.

Figure 19:
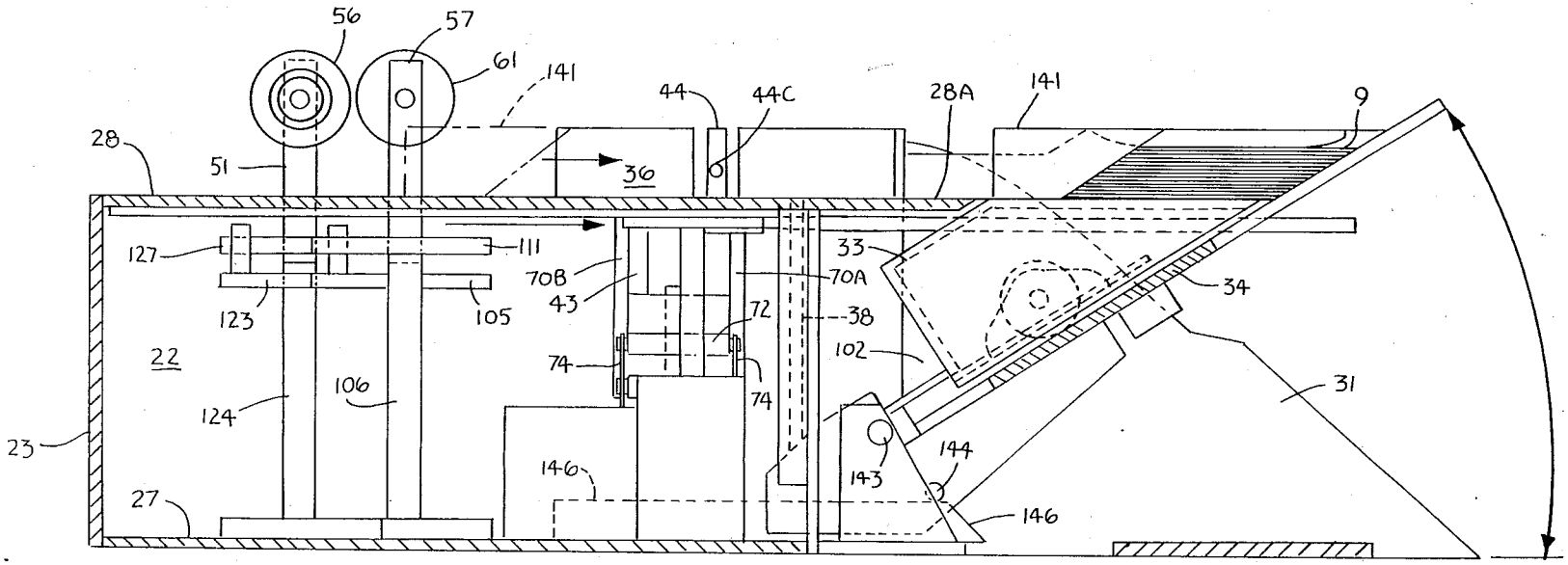
FIG. 19 shows the shoe in its fully elevated position for receipt of the cards, however, with certain parts removed to more clearly show the parts illustrated.

Once the cards are shuffled sufficiently and the shoe 16 is emptied of cards, the mechanism is activated to move deck 9 into the shoe 16. The motor 146A moves member 146 rightwardly thereby raising shoe 16 to the position shown in FIG. 19. The motor 141A is then activated to move push member 141 rightwardly moving deck 9 into shoe 16. Motor 146A then reverses direction thereby lowering shoe 16 to the position shown in FIG. 18.

While certain specific structure has been disclosed herein, it is to be recognized that various modifications can be made without departing from the broader scope of the present invention.

What is claimed is:

1. A card deck shuffling device comprising means for separating the deck into a pair of stacks, means for elevating adjacent portions of each of said card stacks and releasing said portions to interleaf said pair of stacks, means for pushing said pair of stacks into a single stack, and means for moving said stack into a dealing shoe.

2. The card shuffling device of claim 1 wherein said means for elevating comprises a sloped mandrel and means for reciprocably moving said mandrel upwardly and downwardly.

3. The card shuffling device of claim 2 wherein said device includes means for pressing downwardly on said pair of stacks to cause said pair of stacks to snap off said sloped mandrel to interleaf said cards.

4. The card shuffling device of claim 3 wherein said means for pressing comprises a pair of rollers, one roller acting on each of said stacks.

5. The card shuffling device of claim 4 wherein said rollers are each mounted on a shaft such that the rollers may be pivoted out of the way when not in use.

6. The device of claim 2 wherein said mandrel comprises a sloped member mounted to pivot out of the way of said interleafed card stacks while moving downwardly past said interleafed cards.

7. The device of claim 6 wherein said means for separating comprises a reciprocating rod and a carriage, said rod serving to open a space between two portions of cards and said carriage slides beneath the upper of said portions to raise the upper of said portions and transport said upper portion to a location adjacent to the lower of said portions, thereby forming two stacks.

8. A card deck shuffling device comprising means for separating the deck into a pair of stacks, means for moving one of said stacks to a position at an angle to the other stack, means for elevating an adjacent corner of each of said card stacks and releasing said corners to interleaf said pair of stacks, and means for pushing said pair of stacks into a single stack.

9. The device of claim 8 wherein said means for separating comprises a reciprocating rod and a carriage, said rod serving to open a space between two portions of cards and said carriage serving to raise the upper of said portions and transport said upper portion to a location adjacent to the lower of said portions, thereby forming two stacks.

10. The device of claim 9 wherein said means for elevating comprises a frustoconical member.

11. A card deck shuffling device comprising means for separating the deck into a pair of stack portions, means for moving one of said stack portions to a position at an angle to the other stack portion, means for elevating an adjacent corner of each of said card stack portions, said means for elevating comprising a frustoconical member and means for reciprocably moving said member upwardly and downwardly, said frustoconical member serving to elevate adjacent corners of said card stack portions and releasing said corners to interleaf said pair of stack portions, said frustoconical member being mounted to pivot out of the way of said card stack portions while moving downwardly past said interleafed cards, means for pushing said pair of stack portions into a single stack, and means for moving said stack into a shoe.

12. The device of claim 11 wherein said means for separating comprises a reciprocating rod and a carriage, said rod serving to open a space between two portions of cards and said carriage serving to raise the upper of said portions and transport said upper portion to a location adjacent to the lower of said portions.

13. A card deck shuffling device comprising means for separating the deck into a pair of stack portions, said means for separating comprising a reciprocating rod, carriage means for moving one of said stack portions to a position at an angle to the other stack portion, means for elevating an adjacent corner of each of said card stack portions, said means for elevating comprising a sloped curved mandrel and means for reciprocably moving said mandrel upwardly and downwardly, said mandrel serving to elevate adjacent corners of said card stack portions and releasing said corners past the edge of said mandrel to interleaf said pair of stack portions, said mandrel being mounted to pivot out of the way of said interleafed card stack portions while moving downwardly past said cards, means for pressing said card portions downwardly to release said cards over said mandrel, means for pushing said pair of stack portions into a single stack, a shoe and means for moving said stack into said shoe.

14. The card shuffling device of claim 13 wherein said means for pressing downwardly comprise a pair of rollers, one roller acting on each of said stack portions.

15. The card shuffling device of claim 14 wherein said rollers serve to move said stack portions toward each other as the mandrel moves upwardly, thereby assisting in the interleafing of said cards as the cards are released from said mandrel.

16. The card shuffling device of claim 15 wherein said means for moving said stack into said shoe comprise means for pivotally moving said shoe upwardly to a position horizontally aligned with said stack and a push member to slide said stack into said shoe, said pivotal means further serving to move said shoe into a lowered position.

* * * * *